US005405066A

United States Patent [19]

Fakier

[11] Patent Number: 5,405,066

[45] Date of Patent: Apr. 11, 1995

[54] BRACELET FASTENER HELPER

[76] Inventor: Gregory C. Fakier, 1205 Bourg St., Houma, La. 70360

[21] Appl. No.: 131,778

[22] Filed: Oct. 4, 1993

[51] Int. Cl.[6] ..... A47G 25/80; A47G 25/90

[52] U.S. Cl. ..... 223/111

[58] Field of Search ..... 223/111, DIG. 4; 248/215, 340

[56] References Cited

U.S. PATENT DOCUMENTS

| | | | |
|---|---|---|---|
| 607,096 | 7/1898 | Thacher | 248/215 |
| 2,687,836 | 8/1954 | Rhodes et al. | 248/215 |
| 5,087,007 | 2/1992 | Gaderick | 248/215 |
| 5,152,439 | 10/1992 | Simons | 223/114 |

FOREIGN PATENT DOCUMENTS

| | | | |
|---|---|---|---|
| 247664 | 2/1926 | United Kingdom | 248/215 |

*Primary Examiner*—Clifford D. Crowder
*Assistant Examiner*—Bibhu Mohanty
*Attorney, Agent, or Firm*—Pravel, Hewitt, Kimball & Krieger

[57] ABSTRACT

A bracelet clasp fastening aid has a curved portion for gripping the edge of a table or countertop and another curved portion for receiving one's wrist. Pressure is applied from the wrist onto the curved side for the wrist allowing the other hand to be free to attach both sides of a bracelet clasp.

13 Claims, 3 Drawing Sheets

BRACELET FASTENER HELPER

BACKGROUND OF THE INVENTION

1. Field of the Invention

The present invention relates to a device that helps a bracelet owner attach or fasten a bracelet.

2. General Background of the Invention

Many adult women and men do wear or have worn a bracelet. Most have trouble attaching the bracelet with one hand, taking into account that the other hand is being occupied with the bracelet.

There are other devices that help to fasten bracelets. One has an alligator clamp to hold the bracelet and the entire device rests on the top of a table or counter top. The second also has an alligator clamp to hold the bracelet clasp, but it is held by the hand of the arm on which the bracelet will be worn. Neither device locks onto the counter, nor uses pressure from the wrist onto the bracelet onto the surface of device.

SUMMARY OF THE INVENTION

The preferred embodiment of the present invention comprises a simple device with one half-moon shaped curve for the wrist to rest in and another curve consisting of two 90 degree angles to allow the device to lock onto a table or counter top. The bracelet clasp is put onto the wrist and both are laid onto the curved side for the wrist. Pressure is applied from the wrist onto the curved side for the wrist, thus allowing the other hand to be free to attach the other side of the clasp.

The device preferably comprises a hard plastic body type, along with a silicone strip on the end of the curve side for the wrist. More preferably, the device has a flat edge, a slit, and a V shaped notch to allow many different types of bracelets to be attached on the same surface.

BRIEF DESCRIPTION OF THE DRAWINGS

For a further understanding of the nature, objects, and advantages of the present invention, reference should be had to the following detailed description, read in conjuction with the following drawings, wherein like reference numerals denote like elements and wherein.

DETAILED DESCRIPTION OF THE PREFERRED EMBODIMENT

Figure 1:
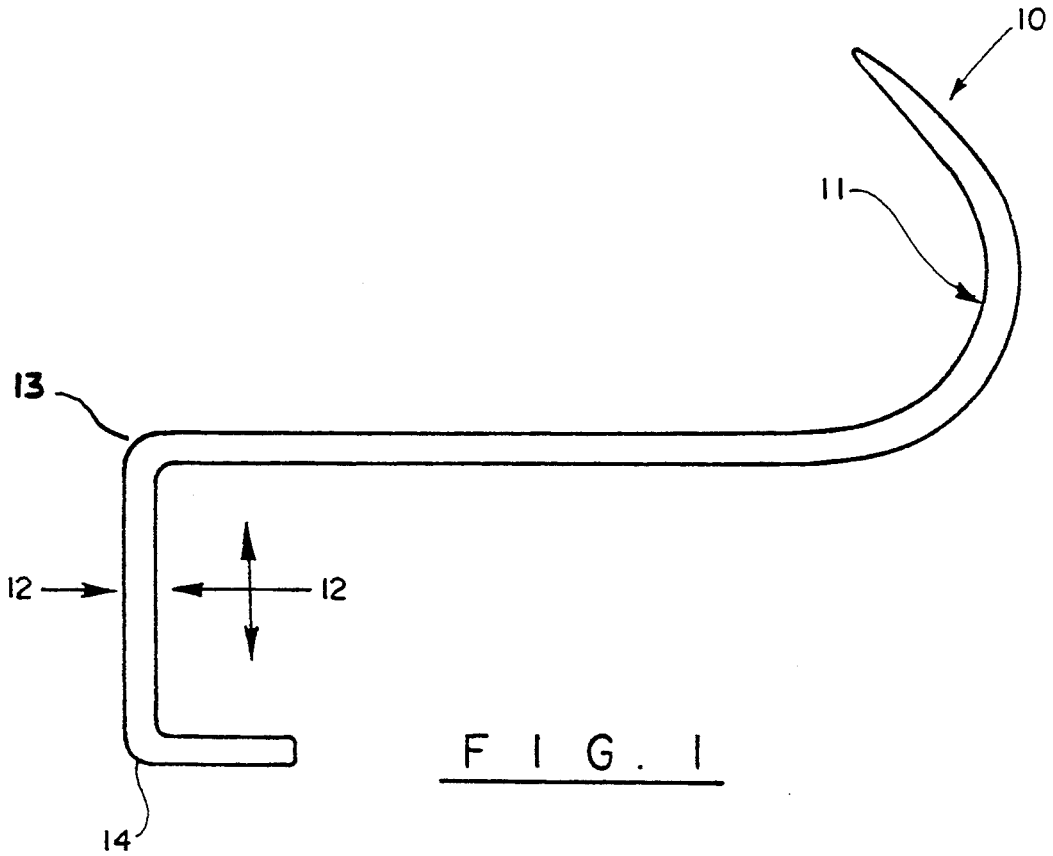
FIG. 1 is a side view of the preferred embodiment of the apparatus of the present invention.
Figure 2:
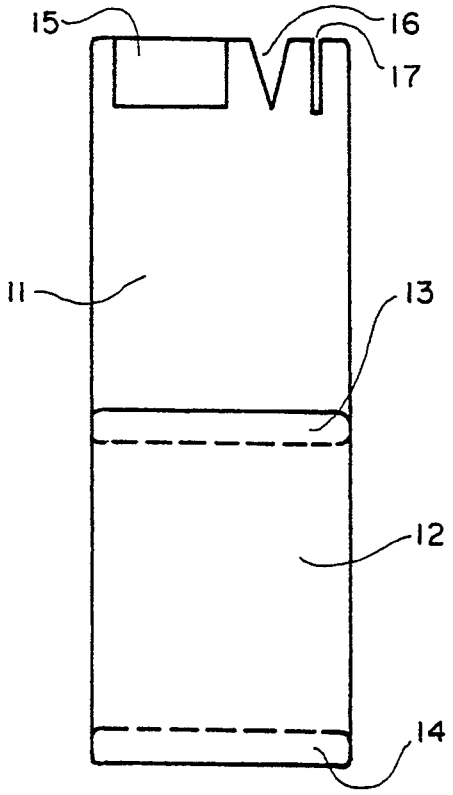
FIG. 2 is a diagram of the end of the curve side end where the bracelet clasp is placed.
Figure 3:
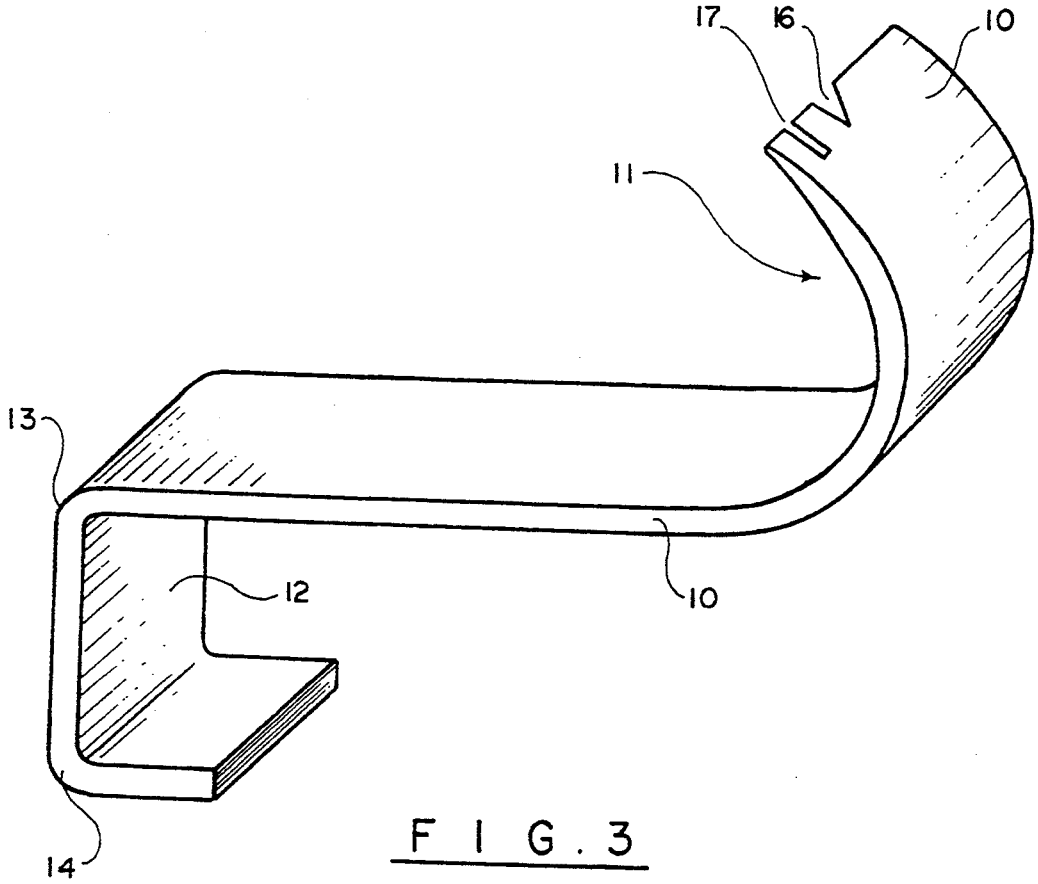
FIG. 3 is a perspective view of the preferred embodiment of of the apparatus of the present invention.
Figure 4:
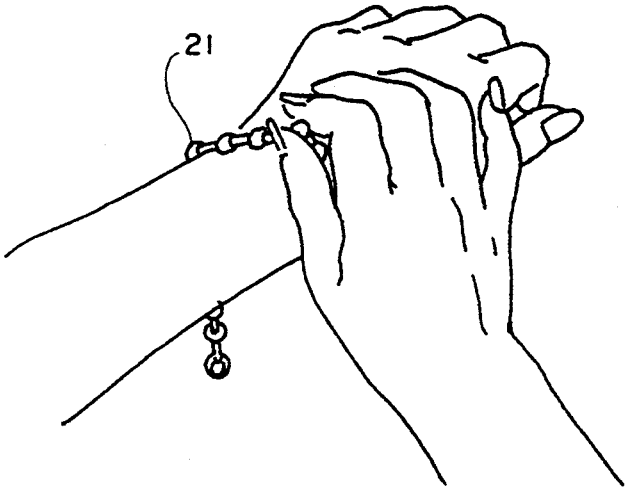
FIG. 4 is a bracelet wearer putting the bracelet in position on the wrist without using the present invention.
Figure 5:
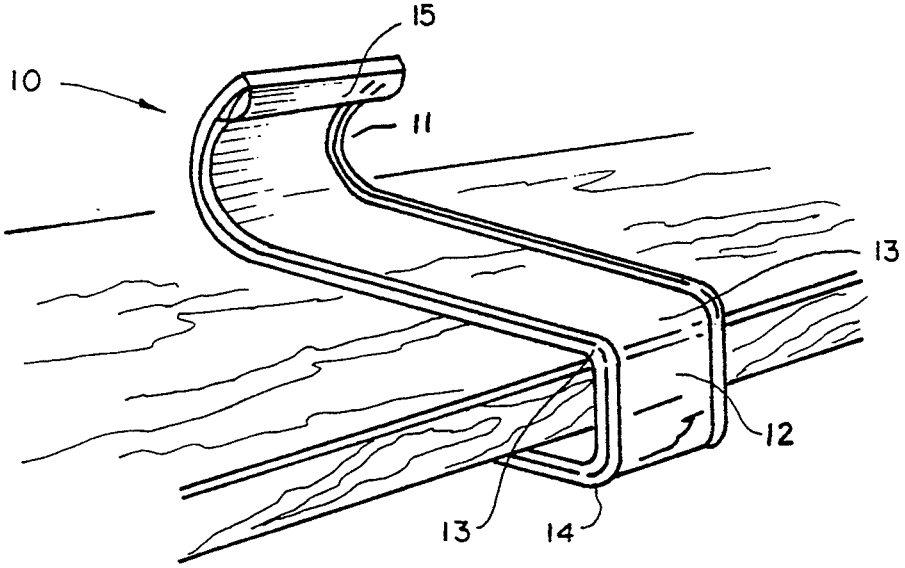
FIG. 5 shows the apparatus in position, hooked on the overhang of some horizontal surface.
Figure 6:
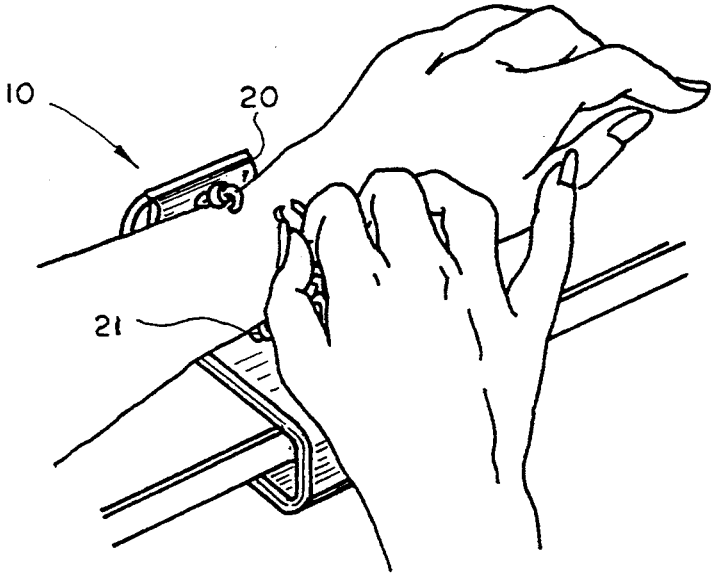
FIG. 6 shows the bracelet between the silicone strip on the apparatus and the arm, with pressure applied by the arm and with the other hand free to fasten the clasp.

The preferred embodiment of the present invention comprises a simple device 10 with one half moon shaped curve 11 fox the wrist to rest in and another curve 12 consisting of two 90 degree angles 13 & 14 to allow the device to lock onto a table or counter top. The bracelet clasp 20 is put onto the wrist and both are laid onto the curved side 11. Pressure must be applied from the wrist on the bracelet 21 to the curved side 11, thus allowing the other hand to be free to attach the other side of the clasp 21.

For example, the device can be made of a clear acrylic body type, and can be 5" inches long and can be 1 ½" wide and can be ¼" thick. The device can be much shorter, longer, wider, narrower, and thicker or thinner. The device preferably comprises a silicone strip 15 on the inside of the curved side 11. More preferably, the device 10 has a shorter silicone strip 15, a slit 16, and a V shaped notch 17 all on the same horizontal position to allow many different types of bracelets to be attached on the same surface. The device preferably has two 90 degree angles to hold secure to the table top and can have, in addition, small suction cups to give added position grip. For example, the suction cups could be positioned anywhere on device that would allow contact with the table top, overhang, or any additional surface.

It is claimed:

1. An invention comprising a device for assisting a person fasten a bracelet, the device comprising:

(a) a first longitudinally extending portion for contacting a table top, (b) a first curved end for receiving a person's wrist and sized to receive the person's wrist, the first curved end extending upwardly from the longitudinally extending portion and including a holding means for holding a bracelet clasp while the person's wrist is received in the first curved end, and (c) means for securing the device against movement, comprising a second curved end sized to fit over an edge of a table or countertop, wherein the device has a width greater than its thickness when installed on a table or countertop with the first curved end extending upwardly from the table or countertop, and wherein the holding means comprises a silicone strip attached to the first curved end.

2. The invention of claim 1, wherein:

the first curved end has pressure applied from the wrist onto the device.

3. The invention of claim 1, wherein:

The first curved end has pressure applied from the device onto the wrist.

4. The invention of claim 2, wherein:

the second curved end has two 90 degree angles.

5. The invention of clim 2, wherein:

the second curved end has two 90 degree angles or another curved end that will secure the device from movement when the second curved end is put over an edge of a table or countertop.

6. The invention of claim 1, wherein the length of the device is five inches, its width is one and a half inches, and its thickness is one quarter inch.

7. The invention of claim 6, wherein the device is made of clear acrylic.

8. The invention of claim 1, wherein the first and second curved ends and the longitudinally extending portion are unitary.

9. The invention of claim 1, wherein when installed on a table or countertop with the first curved end extending upwardly from the table or countertop, the second curved end extends downwardly.

10. The invention of claim 1, wherein the curved ends open in opposite directions.

11. The invention of claim 1, wherein the device has a length greater than its width, and a height less than its length, when installed on a table or countertop with the first curved end extending upwardly from the table or countertop.

12. An invention comprising a device for assisting a person fasten a bracelet, the device comprising:

(a) a first longitudinally extending portion for contacting a table top, (b) a first curved end for receiving a person's wrist and sized to receive the person's wrist, the first curved end extending upwardly from the longitudinally extending portion and including a holding means for holding a bracelet clasp while the person's wrist is received in the first curved end, and (c) means for securing the device against movement, comprising a second curved end sized to fit over an edge of a table or countertop, wherein the device has a width greater than its thickness when installed on a table or countertop with the first curved end extending upwardly from the table or countertop, and wherein the holding means comprises a slit in the first curved end.

13. An invention comprising a device for assisting a person fasten a bracelet, the device comprising:

(a) a first longitudinally extending portion for contacting a table top, (b) a first curved end for receiving a person's wrist and sized to receive the person's wrist, the first curved end extending upwardly from the longitudinally extending portion and including a holding means for holding a bracelet clasp while the person's wrist is received in the first curved end, and (c) means for securing the device against movement, comprising a second curved end sized to fit over an edge of a table or countertop, wherein the device has a width greater than its thickness when installed on a table or countertop with the first curved end extending upwardly from the table or countertop, and wherein the holding means comprises a V-shaped notch in the first curved end.

* * * * *